United States Patent [19]

Baugh

[11] 4,377,015

[45] Mar. 22, 1983

[54] STOVE PIPE CLEANING APPARATUS

[76] Inventor: John E. Baugh, 5500 Pierce Park La., Boise, Id. 83703

[21] Appl. No.: 234,854

[22] Filed: Feb. 17, 1981

[51] Int. Cl.[3] ..... A46B 15/00; A46B 17/00

[52] U.S. Cl. ..... 15/162; 126/307 R

[58] Field of Search ..... 15/242, 243, 249, 162, 15/163; 126/307 R

[56] References Cited

U.S. PATENT DOCUMENTS

| | | | |
|---|---|---|---|
| 450,784 | 4/1891 | Eilbracht | 15/249 |
| 728,508 | 5/1903 | Shields | 15/249 |
| 777,466 | 12/1904 | Yeoman | 15/249 X |
| 1,097,423 | 5/1914 | Givens et al. | 15/242 X |
| 1,161,355 | 11/1915 | Stephens | 15/249 |
| 1,256,402 | 2/1918 | Ware | 126/307 R |
| 2,484,267 | 10/1949 | Bower | 15/242 |

FOREIGN PATENT DOCUMENTS

| | | | |
|---|---|---|---|
| 88073 | 8/1896 | Fed. Rep. of Germany | 15/242 |

*Primary Examiner*—Peter Feldman
*Attorney, Agent, or Firm*—Paul F. Horton

[57] ABSTRACT

Apparatus for the cleaning of stove pipes, in place, comprising a stove pipe elbow of special construction, a brush, and a handle. The stove pipe elbow includes a large opening on its greatest curvature for brush removal and insertion and a lid for covering the opening to prevent toxic fumes from entering the room during use. The lid is provided with a longitudinal slot operable to slidingly receive the handle during the clean-out operation and permits the cleaning of stove pipes which are connected to the elbow in perpendicular orientation one to the other. A small cover plate is provided to cover the slot during periods of stove use. The handle, which is removed from the brush upon completion of the clean-out procedure, is preferably made of flexible material to facilitate use. The elbow may be provided with a brush storage compartment.

5 Claims, 3 Drawing Figures

STOVE PIPE CLEANING APPARATUS

FIELD OF THE INVENTION

This invention relates to stove pipe cleaning apparatus and particularly to apparatus operable to clean both vertical and horizontal pipes.

DESCRIPTION OF THE PRIOR ART

Relevant prior art devices include those disclosed in U.S. Pat. Nos. 117,642; 404,553; 425,057; 539,391; 552,395; and 606,581. Heretofore, in related art, both vertical and horizontal pipes could not be cleaned from a single closeable opening; the brush or scraper could only be stored in the chimney with the handle extending the entire length of the horizontal pipe; and the handle could only be used in direct axial relationship to the pipe to be cleaned.

SUMMARY OF THE INVENTION

In accordance with the present invention, apparatus is provided which includes a stove pipe elbow having a large opening at a 45° angle to both the horizontal and vertical legs of the elbow. The elbow is further provided with a lid for sealing the opening. The lid is equipped with a longitudinal slot which is operable to receive a handle which may be placed in alignment with either leg of the elbow. A slot closure member is provided for covering the slot during periods of stove use. Additionally, a flexible handle is provided which detachably connects to a brush which is held in storage in the elbow adjacent the lid. A more complete and definite description of the invention may be found in the appended claims. It is the intent of the present invention to overcome the cited difficulties of prior art inventions.

DETAILED DESCRIPTION OF THE INVENTION

Figure 1:
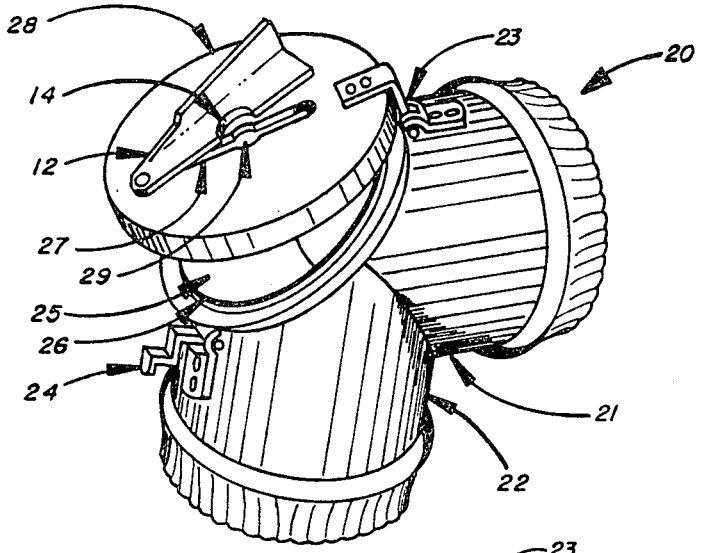
FIG. 1 is a perspective view of the stove pipe elbow of the present invention.

Referring now to the drawings, an embodiment to be preferred of the stove pipe cleaning apparatus of the present invention is disclosed. The stove pipe cleaning apparatus of the present invention includes, generally, a stove pipe elbow 20, a brush or scraper 30, and a brush handle 40.

Figure 2:
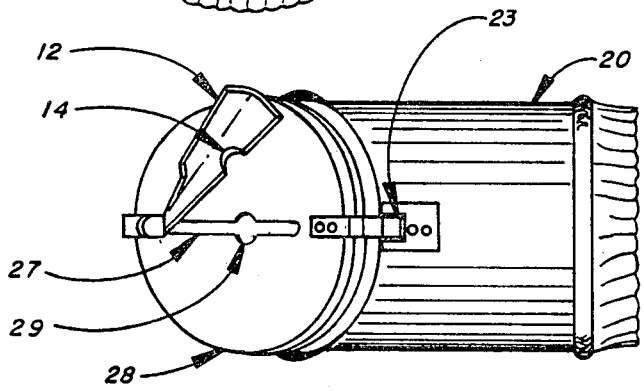
FIG. 2 is a top view of the elbow of FIG. 1

Elbow 20, as is conventional, includes a pair of tubular legs, horizontal leg 21 and vertical leg 22 which are adapted for connection to horizontal and vertical stove pipes, respectively. Elbow 20 is provided with a large opening on the upper and outer surface of the joinder of the two legs, defined in the claims as the greatest curvature. The opening is of adequate size to insert or remove the brush for the cleaning of attached stove pipes and is therefore substantially equal to the diameter of the legs of the elbow. The opening, designated by the numeral 25 is surrounded by a raised anular sleeve 26 which may be integral with or appropriately sealed to the casing defining the legs. Elbow 20 is further provided with a lid 28 which tightly engages the sleeve for closure of opening 25. As shown in the figures, lid 28 is preferably attached to one of the elbow legs by means of hinge 23 to pivot downwardly in engagement with the sleeve. A latch 24 may be provided to insure the integrity of the seal. Other methods of connecting the lid to the sleeve for closure of opening 25 such as a screw-on lid are within the contemplation of the invention. Lid 28 is provided with a longitudinal slot 27 which is oriented, as shown in FIGS. 1 and 2 so that a handle protruding therethrough may be placed in axial alignment with either leg of the elbow. In the preferred embodiment, a central aperture 29 is also provided in the lid for receiving an outwardly extending projection of brush 30, as will hereinafter be explained. A slot cover 12 pivotally engages the outer surface of lid 28 for covering the slot opening during periods of stove use. Closure member 12 may include a recessed portion 14 for accommodating the brush projection.

Brush means 30 may be in the form of any conventional brush or scraper now in the art. It is contemplated that the brush will be substantially equal in diameter to the interior diameter of the elbow legs and the stove pipes to be cleaned. In the preferred embodiment, brush 30 includes a centrally located outwardly extending threaded projection 33. The threaded aperture of projection 33 is operable to engage a threaded portion 43 of handle 40. Elbow 20, in the preferred embodiment, includes a brush storage compartment within sleeve 26. Sleeve 26, shown to advantage in FIG. 3 may be provided with two or more retention members 8 extending radially inward from the sleeve. Crimps within sleeve 26 have proven adequate for retaining the brush. While in the storage mode, projection 33 of brush 30 extends through aperture 29 of the lid. In this manner, the brush is conveniently attached to flexible handle 40 which is stored externally.

Handle 40 includes a flexible rod portion manufactured preferably of fiberglass. One terminal end of the rod is adapted for temporary attachment to brush 30 as by means of threaded portion 43 which screws into threaded projection 33 of the brush.

Figure 3:
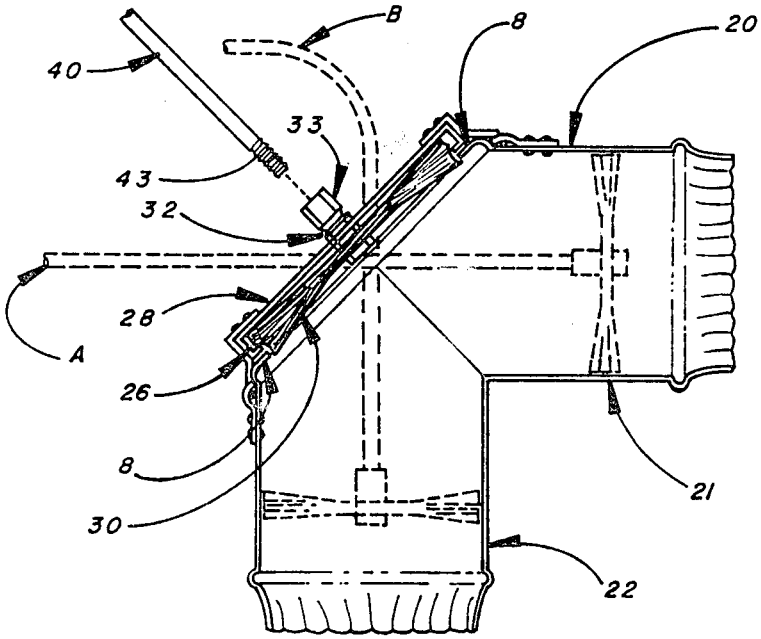
FIG. 3 is a side sectional view of the elbow showing positioning of the brush during storage and positioning of brush and flexible handle during use.

In operation, lid 28 of elbow 20 is opened for visual inspection of the horizontal and vertical stove pipes connected to the elbow. Assuming the pipes are in need of cleaning, flexible handle 40 is attached to brush 30 by screwing the threaded end portion 43 of the handle into threaded projection 33 of the brush. With the lid in a closed position, the brush is removed from its retainer 8 by simply pushing on rod 40. In the event that the horizontal stove pipe is to be cleaned, the rod is lowered into the bottommost portion of slot 27, as shown in FIG. 3, and the brush moved horizontally to and fro by a light movement of rod 40 as shown in outlying position A of the figure. In the event the vertical pipe is to be cleaned, rod 40 is placed at the uppermost portion of slot 27 as shown in FIG. 3 for axial alignment with the vertical pipe. The rod may then be curved as in outlying position B and a horizontal movement of one end of the rod results in a vertical movement of the brush end of the rod for cleaning the vertical pipe. It is to be noted that where the elbow is in close confinement with an adjacent wall, ceiling, or both, the flexible rod permits cleaning which is otherwise impossible with non-flexible rods. It is further to be noted that recess portion 14 of slot closure member 12 is operable to engage anular groove 32 of projection 33 so that opening of lid 28 causes brush 30 to be carried by the lid when opened. In this manner, convenient attachment of rod 40 to the brush is made possible. Once the pipes have been cleaned, brush 30 is again retracted into the sleeve and lid in the position shown in FIG. 3; closure member 12 is pivoted so that recess 14 engages slot 32 of projection 33 of the brush and flexible rod 40 is unscrewed from its temporary attachment to the brush. The brush thus remains within the elbow for storage and flexible handle 40 is stored exterior to the apparatus.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Stove pipe cleanout apparatus comprising:

a stove pipe elbow having an opening upon its greatest curvature, the opening adapted for passage of a brush therethrough and surrounded by a raised sleeve adapted to receive and hold brush means for storage; a lid hingeably engaging the elbow and operable to engage the outer surface of said sleeve for closure of the opening, said lid including a longitudinal slot alignable with tubular projections of said elbow, the slot adapted to receive a brush handle and said lid further including slot closure means pivotally engaging said lid;

brush means insertable through the opening of said elbow; and handle means operable to removeably engage said brush through said slot for the cleaning of stove pipes.

2. The apparatus as described in claim 1 wherein said slot closure means includes a recessed portion adapted to engage and hold said brush means in place.

3. The apparatus as described in claim 1 wherein said brush means includes a centrally threaded outwardly extending projection operable to engage a threaded end of said handle means.

4. The apparatus as described in claim 1 wherein said handle means includes a longitudinal rod made of flexible material.

5. The apparatus as described in claim 1 wherein said brush storage means includes at least two retention members extending radially inward from said sleeve.

* * * * *